United States Patent [19]

Capdeboscq

[11] 4,181,298

[45] Jan. 1, 1980

[54] DEVICE FOR SYNCHRONIZED INTRODUCTION OF SHEETS INTO A TREATMENT MACHINE

[75] Inventor: Bernard Capdeboscq, St. Just Chaleyssin, France

[73] Assignee: S.A. Martin, Villeurbanne, France

[21] Appl. No.: 911,145

[22] Filed: May 31, 1978

[30] Foreign Application Priority Data

Jun. 2, 1977 [FR] France ..... 77 16831
Feb. 27, 1978 [FR] France ..... 78 05494

[51] Int. Cl.[2] ..... B65H 3/64
[52] U.S. Cl. ..... 271/5; 271/6; 271/35; 271/99; 271/106; 271/132
[58] Field of Search ..... 271/5, 6, 99, 102, 106, 271/35, 132, 10

[56] References Cited

U.S. PATENT DOCUMENTS 3,941,372 3/1976 Matsuo ..... 271/99 X
3,973,768 8/1976 Shannon ..... 271/132 X

*Primary Examiner*—Richard A. Schacher
*Attorney, Agent, or Firm*—Haseltine, Lake & Waters

[57] ABSTRACT

In a device for the synchronized introduction of sheets into a treatment machine, e.g. a printer-slotter or cutter for processing corrugated cardboard sheets, in which a reciprocating pusher pushes forward the lowermost sheet of a stack in a magazine between two stops and into engagement with feed rollers, the stack rests on the upper run of a set of endless belts, which upper run extends over a suction box which is maintained continuously under suction during forward movement of the pusher, the belts are driven forwardly to facilitate movement of the lowermost sheet from the bottom of the stack, and belts being immobile during the return movement of the pusher.

5 Claims, 5 Drawing Figures

FIG 3
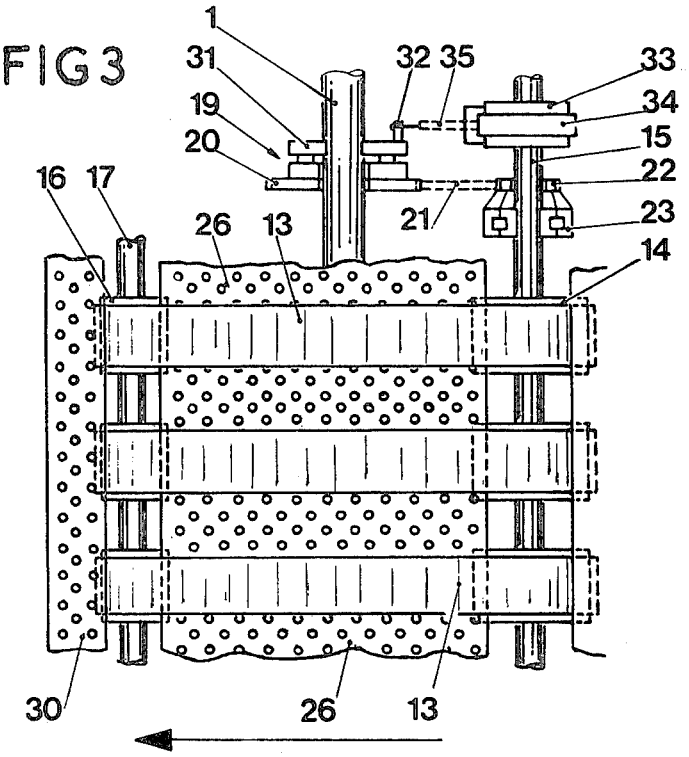
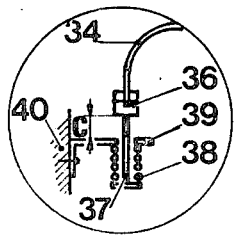
FIG5
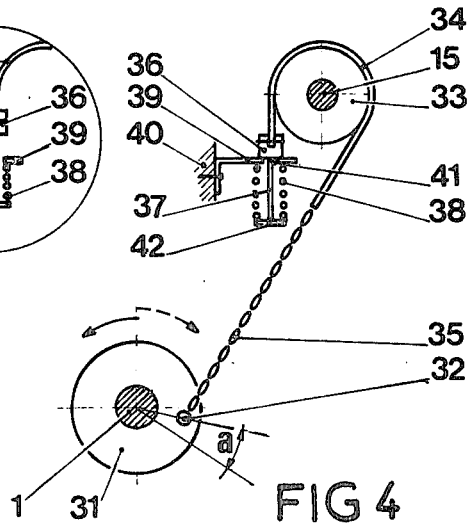
FIG 4

DEVICE FOR SYNCHRONIZED INTRODUCTION OF SHEETS INTO A TREATMENT MACHINE

The present invention relates to a device for the synchronised introduction of sheets into a treatment machine, into which the sheets have to be introduced one by one by successively taking a sheet from the bottom of a stack in a magazine.

It is particularly but not exclusively applicable, for example, to the feed stroker of a printer-slotter or of a cutter intended for processing corrugated cardboard sheets for the production of packagings. In such a machine, which generally possesses tools for cutting, printing or local crushing of the board to form subsequent folds, the blank sheets in a magazine, which forms a feed reservoir, are introduced successively, in phase with the rotation of the cutting or printing tools. The precision with which each sheet is introduced into the machine at a suitable instant of the cycle determines the correct position of the cuts and of the compressed portions on the sheet, that is to say the dimensional precision of the finished packaging box. This precision is even more important if the box subsequently has to pass through automatic folding machines, which at the present time is increasingly frequent.

The device most frequently used in conventional devices consists of a pusher having a transverse straightedge, subjected to a reciprocating movement and equipped with grips mounted on elastic strips. In the forward movement of the pusher, the grips push the rear edge of the bottom sheet of the stack so as to bring it to drive rollers which subsequently guide it into the machine. To avoid several sheets being carried along simultaneously under the effect of friction, stops of adjustable height are arranged at the front of the magazine, and are adjusted so as to leave between them and the sheet-introducing table a gap barely greater than the thickness of one sheet. Thus, only the lowest sheet can pass between the stops and the next sheet is stopped until the preceding sheet has been completely discharged, causing the next sheet to fall onto the table in position to be pushed forward by the next movement of the pusher.

This conventional device proves entirely satisfactory, in particular as far as the precision of introduction is concerned, where cardboard sheets of good planarity are involved, and where the cardboard is sufficiently thick to have good resistance to buckling under the combined effect of the impact of the pusher on the rear edge and of inevitable braking between the front stops.

However, it frequently happens that the sheets are deformed so that the front edge is raised. If this happens they no longer pass through the normal gap between the stops, and a sheet, blocked at the front and pushed from the back, is inevitably damaged. If the front stops are spaced further from the table, there is the danger that two sheets may pass simultaneously, which also disturbs the running of the slotter.

Various solutions have already been proposed to allow the normal passage of deformed sheets, generally using press-down devices for applying the lowest sheet against the table.

Systems which use suction devices which can undergo a reciprocating movement, and without using a pusher, have the disadvantage of allowing slippage and hence not always ensuring sufficient precision of feed.

To avoid this disadvantage, the combination of a conventional pusher, which ensures precision by means of its positive action, with fixed or reciprocating components of a suction table, has been used. However, if reciprocating suction components are used, there is still the danger of causing unintentional shifts of the sheets during the return stroke, which interferes with the precision of introduction. Alternatively, it is necessary alternately to produce and remove the suction effect, which complicates the device, without ensuring that it functions perfectly at high speed. If, on the other hand, fixed suction components are used, additional braking of the forward movement of the sheet is caused, which interferes with the normal introduction of very lightweight cardboards and causes damage by the pusher.

According to the invention there is provided a device for the synchronised introduction of sheets into a treatment machine from a stack of sheets, the device comprising a magazine for receiving a stack of sheets and including a feed table on which the lowest sheet of the stack rests, a pusher for performing a rectilinear reciprocating movement and driven by a drive shaft arranged to perform an alternating rotational movement, in phase with the general drive of the treatment machine, so as, at each cycle, successively to cause said pusher to push the lowest sheet of a stack forward between adjustable stop means and towards rollers for driving the sheet into the machine, characterised in that the device furthermore comprises, wherein, at the front part of said table, endless belt means is provided with its upper run above a suction box adapted to be maintained under continuous suction, said belt means being adapted to be driven by said drive shaft via freewheel transmission means arranged such that, during the forward movement of said pusher, said belt means are driven forward by the same distance and in the same direction as said pusher, and, during the return movement of said pusher, said belt means remain immobile.

The sheet-introducing device may include an auxiliary device for imparting a slight return movement to the belts when the pusher arrives at the end of its return movement.

The invention will be more fully understood from the following description of an embodiment thereof, given by way of example only, with reference to the accompanying drawings.

In the drawings:

FIG. 3 is a view similar to FIG. 2 showing use of an auxiliary device;

FIG. 4 is a partial elevation view in which only the auxiliary device, in the neutral position, has been shown; and FIG. 5 is an enlarged detail of the auxiliary device in position at the end of the return movement of the belt means.

Figure 1:
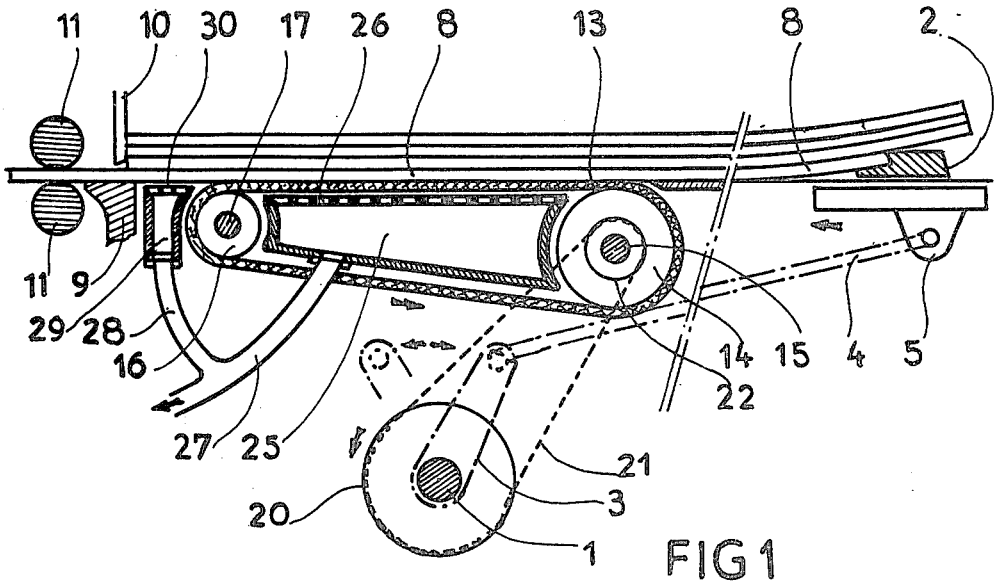
FIG. 1 is a simplified view, in longitudinal section, of a device according to the invention.
Figure 2:
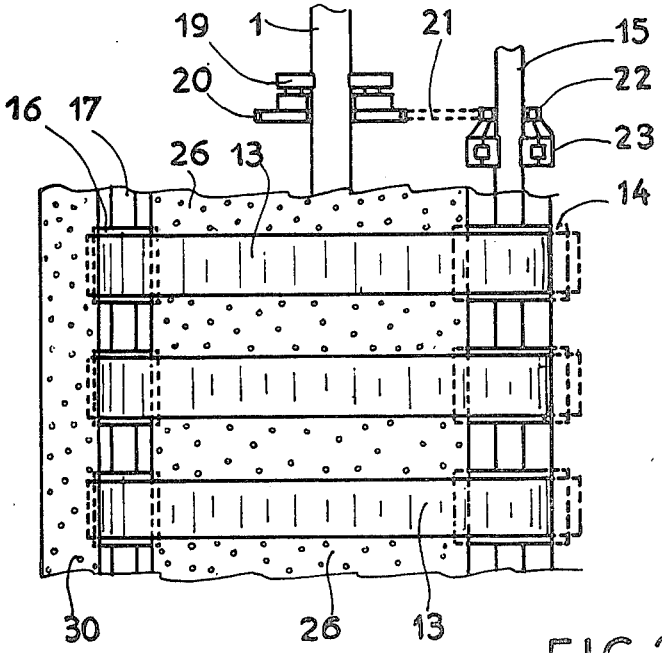
FIG. 2 is a partial top view of the device of FIG. 1.

The Figures show, at least schematically, the known components of a conventional pusher-type stroker for a printer-slotter or a cutter machine. A shaft 1 is driven with an alternating rotational movement by means of the general drive motor of the machine and via a linkage system (not shown), so that the alternating cycle of the shaft corresponds to the cycle of rotation of the revolving cutting and printing tools of the machine. The drive linkage system of the shaft 1 is generally complex in order that the alternating cycle of the shaft 1 should not be sinusoidal but should comprise a higher acceleration stage, corresponding to the forward stroke of pusher 2, and a slower stage corresponding to the return stroke of the pusher. The alternating cycle of rotation of the shaft 1 is converted to a linear alternating cycle of the pusher 2 by cranks 3 and connecting rods 4. In practice, the connecting rods 4 engage longitudinal slides 5 to which the pusher 2 is fixed, the position of the pusher 2 relative to the slides 5 being adjustable in accordance with the format of the sheets being processed.

The pusher 2 operates in a conventional manner, that is to say by engaging, during its forward stroke, the rear edge of the lowest sheet 8 in the stack in the magazine. The sheet 8 is pushed by the pusher between a fixed member 9 and a height-adjustable stop 10 to engage it between the drive rollers 11 which continue to move the sheet forward during the return movement of the pusher. The gap between the member 9 and the stop 10 is sufficient to allow one sheet to pass but insufficient to allow two to pass, so that the next sheet in the stack is stopped by striking against the stop 10.

In its front part the feed table comprises a series of endless drive belts 13 wound round a series of drive pulleys 14 fixed to a drive shaft 15 and round return pulleys 16 mounted on a shaft 17. The shaft 15 is driven from the shaft 1, successively via a clutch 19, of which one part is firmly fixed to the shaft 1 and the other is firmly fixed to a sprocket wheel 20 freely rotatably mounted on the shaft 1, a chain 21 and a sprocket wheel 22 freely rotatably mounted on the shaft 15 and connected to one of the parts of a freewheel clutch or device 23 of which the other part is keyed to the shaft 15. The freewheel device 23 is mounted so as to drive the shaft 15 and the pulleys 14 only in the direction of the rotational movement of the shaft 1 indicated by the arrow in FIG. 1, that is to say during the forward movement of the pusher 2. When the shaft 1 rotates in the opposite direction, that is to say during the return movement of the pusher 2, the pulleys 14 and the belts 13 are not driven. The ratio of the sprocket wheels 20 and 22 is so chosen, in accordance with the length of the crank 3, that the linear speed of the belts 13 is equal to the linear speed of the pusher 2 during its forward stroke.

A suction box 25 is located under the active upper runs of the belts 13 and comprises an upper perforated metal sheet 26 and a pipeline 27 for connecting it to a vacuum pump.

The vacuum pump is also connected to a pipeline 28 to create a subatmospheric pressure in a small transverse suction box 29 located near the front of the magazine, between the pulleys 16 and the member 9. The box 29 comprises an upper perforated plate 30.

During the end of the engagement of a sheet in the machine and the return stroke of the pusher 2, the belts 13 are immobile and the lowest sheet of the stack in the magazine is progressively applied against the belts and the table by the action of suction from the boxes 25 and 29, with air being drawn through the perforated plates 26 and 30. When the pusher 2 arrives at its rearmost position, the bottom sheet of the stack is thus applied perfectly against the table. When the pusher 2 starts its forward stroke and comes into contact with the rear edge of the sheet, the freewheel device 23 drives the shaft 15 and hence the belts 13 undergo a forward movement synchronised with that of the pusher. Hence, the effect of friction of the sheet against the table disappears and movement of the sheet is assisted by the belts 13, whilst positive positioning of the sheet is provided by the pusher 2.

It will be noted that the effect of the suction box 29 is limited to a very short zone in the immediate vicinity of the stops 10 so that the frictional effect against these fixed suction boxes is insufficient to create a real hold-back of the sheet. The box 29 facilitates the passage of the front edge of the sheet under the stops 10.

The coordinated action of the pusher and of the belts causes virtually all the forces acting on the sheet to disappear so that extremely lightweight and very weak sheets of cardboard can be introduced, even at high speed, in particular, with corrugated sheets, if the sheets are introduced with the grooves transverse to the direction of movement.

When the lowest sheet of the stack is pushed towards the machine inlet, the sheet located immediately above it strikes the stop 10, which thus prevents it from being carried along by friction. If very deformed sheets of extremely lightweight board are used, it can happen that this thrust against the stop 10 is sufficient to crush the front edge of the sheet against the stop and even to fold it upwards. In that case, in spite of the suction force, the sheet will no longer descend into contact with the sheet-introducing table, and its front edge will not align itself with the gap between the member 9 and the stops 10. It is sometimes attempted to overcome this disadvantage by sloping the stops forward or bevelling them, but this has the disadvantage of facilitating the simultaneous passage of several sheets, if these are of good planarity.

Reference will now be made to FIGS. 3, 4 and 5, which describe an auxiliary device by means of which sheets can be disengaged from the stops 10 so that they can rest completely flat on the sheet-introducing table.

As shown in FIG. 3, the drive shaft 15 of the belts carries, in addition to the freewheel clutch 23, an auxiliary drum 33 keyed to the shaft. The part 31 of the clutch 19 which is fixed to the shaft 1 comprises an attachment point 32 to which is anchored one of the ends of a chain 35, of which the other end is attached to one end of a strap 34 which passes round the drum 33. The other end of the strap 34 is fixed to a cylindrical member 36 which rests on a bracket 39 fixed to the framework 40 of the machine. The bracket 39 is provided with a hole 41 along the axis of the member 36. A rod 37 passes through this hole, one end of the rod 37 being fixed to the member 36, whilst its other end carries a flat head 42. A compression spring 38, between the head 42 and the bracket 39, urges the member 36 against the bracket 39. When the strap 34 is tensioned, it bears against the drum 33 and forms a drive belt for the drum and hence for the shaft 15 which drives the belts. Conversely, if the strap is not tensioned, it does not drive the drum 33.

The auxiliary device functions as follows: during the forward movement of the pusher, the shaft 1 and the disc 31 rotate through part of a turn in the direction indicated by the solid arrow in FIG. 4. During this movement, the chain 35 is completely untensioned, so that the strap 34 does not drive the drum 33. The shaft 15 is however driven by the freewheel clutch 23.

During the major part of the return movement of the pusher, during which the freewheel device no longer drives the shaft 15, the disc 31 and the shaft 1 rotate in the direction shown in broken lines in FIG. 4. When the position shown in this Figure is reached, the chain 35 becomes tensioned and the strap 34 is applied against the drum 33, starting gradually to couple thereto by friction, like a conventional clutch. The disc 31, which continues to turn, tensions the strap 34 further, by compression of the spring 38 (FIG. 5). The belt 34 and drum 33 become coupled together and the drum 33, and hence the shaft 15, rotate in a direction corresponding to a return or rearward movement of the belts 13. Return movement of the belts takes place during the last part a of rotation of the shaft 1, which brings the pusher into its extreme rear position. During this angular movement a the strap 34 and the member 36 undergo a linear movement c (FIG. 5).

The rearward movement of the belts 13 causes the lowest sheet to move slightly away from, and disengages it from, the front stop 10. The sheet can then freely rest against the belts and the box 30, ensuring that it is flattened.

It will be appreciated that the clutch device 33, 34 could be replaced by any other suitable device, which may be mechanical, electromechanical, electronic or the like in nature, and which imparts to the shaft 15, and hence to the belts 13, a slight rearward movement during the last part of the return movement of the pusher. A purely mechanical system employing a clutch, as described above, may be preferred for various reasons. However it is entirely possible to impart to the shaft 15 its slight return movement by means of an electric motor which is fed with current during the last part of the return movement of the pusher, the current being supplied by an electrical, electro-optical or programmed control device.

If it is desired to stop introduction of sheets into the machine without stopping the machine, the conventional pusher systems are generally provided with means for raising the rear edge of the stack so that the pusher passes under the bottom sheet without engaging it. In this embodiment it is obviously necessary also to interrupt movement of the belts 13, and this is achieved by operating the clutch 19.

Of course the invention is not strictly limited to the embodiment which has just been described by way of example only but also embraces embodiments which only differ therefrom in details, in differences in the method of realisation, or in the use of equivalent means. For example, the small fixed suction box 29 at the front can be omitted if the arrangement of the unit makes it possible to bring the front return pulleys of the belts sufficiently forward. Equally, it is possible to replace the clutch 19 by a rocking device for the whole of the belt-suction box systems, which would then be disengaged from the underside of the bottom sheet of the stack by operation of the rocking device.

What is claimed is:

1. In a device for the synchronised introduction of sheets into a treatment machine from a stack of sheets, the device comprising:

a magazine for receiving a stack of sheets and including a feed table on which the lowest sheet of the stack rests;

a pusher for pushing the lowest sheet in a stack in the magazine forward out of said magazine;

adjustable stop means between which the sheet is pushed by said pusher;

rollers for driving the sheet passing through said stop means forward into the machine;

means for causing rectilinear reciprocating movement of said pusher comprising a drive shaft and means for driving said shaft with an alternating rotational movement, in phase with the general drive of the treatment machine, so as, in each cycle, successively to cause said pusher to push the lowest sheet of a stack forward between said adjustable stop means and towards said rollers for driving the sheet into the machine;

the improvement comprising, at the front part of the feed table, a suction box, means for continuously maintaining said suction box under suction, endless belt means of which the upper run extends above said suction box, and means for driving said belt means from said drive shaft including freewheel transmission means arranged such that, during the forward movement of said pusher, said belt means are driven forward by the same distance and in the same direction as said pusher, and during said return movement of said pusher, said belt means remain immobile.

2. A device according to claim 1, wherein said transmission means includes an engagement-disengagement clutch means.

3. A device according to claim 1 or claim 2, including a fixed suction box of small size in the longitudinal direction in the zone between the front end of said belt means and said adjustable stop means, and means for maintaining said box under continuous suction.

4. A device according to claim 1 or claim 2, including an auxiliary device for causing said belt means to move rearwardly when said pusher arrives at the end of its return movement.

5. A device according to claim 2, including an auxiliary drive device for driving said belt means, independent of said freewheel transmission means, and means for coupling said auxiliary drive device to said drive shaft of said pusher solely during the final stage of the return movement of said pusher.

* * * * *